United States Patent [19]

Wolfberg et al.

[11] Patent Number: 5,001,500

[45] **Date of Patent: * Mar. 19, 1991**

[54] ENDLESS BELT PRINTING APPARATUS

[75] Inventors: Larry Wolfberg, Honolulu, Hi.; John Harper, Wichita, Kans.

[73] Assignee: L & C Family Partnership, Honolulu, Hi.

[ * ] Notice: The portion of the term of this patent subsequent to May 2, 2006 has been disclaimed.

[21] Appl. No.: 409,686

[22] Filed: Sep. 20, 1989

Related U.S. Application Data

[63] Continuation-in-part of Ser. No. 323,399, Mar. 14, 1989, Pat. No. 4,968,993, which is a continuation of Ser. No. 942,324, Dec. 16, 1986, Pat. No. 4,827,315.

[51] Int. Cl.[5] ..... G03G 15/22

[52] U.S. Cl. ..... 346/160; 346/76 L; 355/218; 355/310

[58] Field of Search ..... 346/76 L, 153.1, 160; 355/218, 310, 212; 400/118, 119, 578, 581, 582, 583, 587, 593, 611, 614, 621; 229/69, 73

[56] References Cited

U.S. PATENT DOCUMENTS

| | | | |
|---|---|---|---|
| 4,258,113 | 3/1981 | Kuehnle . | |
| 4,484,809 | 11/1984 | Coleman . | |
| 4,600,296 | 7/1986 | Hage | 355/212 |
| 4,603,336 | 7/1986 | Dufour et al. | 355/210 X |
| 4,606,955 | 8/1986 | Eastman et al. . | |
| 4,609,277 | 9/1986 | Yokoyama et al. | 355/212 |
| 4,630,919 | 12/1986 | Fantuzzo et al. . | |
| 4,668,072 | 5/1987 | Yasuda . | |
| 4,674,858 | 6/1987 | Nagayama . | |
| 4,711,562 | 12/1987 | Pothast et al. . | |
| 4,756,992 | 7/1988 | Cheng . | |
| 4,758,486 | 7/1988 | Yamazaki et al. . | |
| 4,761,669 | 8/1988 | Langdon . | |
| 4,769,672 | 9/1988 | Hoshi et al. . | |
| 4,772,253 | 9/1988 | Koizumi et al. . | |
| 4,788,572 | 11/1988 | Slayton et al. . | |
| 4,791,450 | 12/1988 | Mosehauer et al. . | |
| 4,794,421 | 12/1988 | Stoudt et al. . | |
| 4,806,972 | 2/1989 | Tomoyori et al. . | |
| 4,809,040 | 2/1989 | Regnault et al. . | |
| 4,810,604 | 3/1989 | Schmidlin . | |
| 4,827,315 | 5/1989 | Wolfberg et al. | 346/160 |

OTHER PUBLICATIONS

Day Arrives for AM's Unique 'Electropress', by Patrick Henry, Printing News Technology Watch, Jun. 11, 1990.

*Primary Examiner*—Peter S. Wong
*Assistant Examiner*—Emanuel T. Voeltz
*Attorney, Agent, or Firm*—Banner, Birch, McKie & Beckett

[57] ABSTRACT

A method and apparatus for the automatic production of business forms, wallpaper, newspapers or the like from a web of continuous printing material comprises an endless movable belt having at least one printing station. An image is projected to a surface of the belt. The image is transferred to the web of continuous material at the at least one printing station. Immediately after image transfer, the image is erased from the belt so that a remaining portion of the image may be projected onto its surface at the printing station. In this manner the device appears to provide a printing surface of indeterminate length and so is designed without relation to the image to be projected. A plurality of such printing stations may be arranged in series for color printing. Two more printing stations may be associated with one endless belt for printing two or more colors or two sides of the web. Furthermore, the operation of the printing station and associated activities may be controlled by a pre-selected computer program.

32 Claims, 5 Drawing Sheets

ENDLESS BELT PRINTING APPARATUS

This is a continuation-in-part application of U.S. application Ser. No. 323,399 filed Mar. 14, 1989, now U.S. Pat. No. 4,968,993, which is a continuation of U.S. application Ser. No. 942,324 filed Dec. 16, 1986, now U.S. Pat. No. 4,827,315.

BACKGROUND OF THE INVENTION

1. Technical Field

This invention relates to the field of printing press apparatus for automatically printing a web of material and, more particularly, to a printing press including an endless belt having at least one associated printing station.

2. Description of the Relevant Art

In the art of manufacturing continuous, multi-part business forms, printing newspaper or even wallpaper and in the printing press art in general, a major shortcoming is that the size of the print pattern is limited to the size, i.e., the diameter, of the printing cylinder. As a result, printing cylinders must be changed often in order to accommodate various lengths or repeats in the desired work product.

According to one embodiment of our invention, represented by U.S. Pat. No. 4,827,315, the printing cylinder has an indeterminate length in the sense that it is able to print at any desired length or pattern repeat without the necessity of changing cylinders. In this respect, the cylinder surface may be regarded as a constantly moving surface, miles long, rather than any fixed size. This is because an ionized beam is projected onto the cylinder to create an image thereon which is transferred to a continuously moving web. As the cylinder revolves past the printing position, the image is erased and another image is formed, so as to present a constantly changing image to the web for continuous printing independent of cylinder size.

More specifically, the drum or print cylinder is provided with an image receiving photoconductor surface which is rotated past a charging or projection station where laser beams are utilized to project images on the cylinder surface. This is accomplished using laser printing technology such as that disclosed in U.S. Pat. No. 3,836,917. This cylinder is then rotated to a development station where a powder or toner is selectively deposited on only the charged image areas. When a plurality of colors are used for a particular business forms application, as many as four or more cylinders are employed, each applying a single color.

After the image is transferred to the web, the sheet or web is passed through heating and chilling sections to fix the toner or powder on the web.

Meanwhile, immediately after the images from the respective cylinders are transferred onto the web, the images are erased, again with the aid of laser beams which discharge the photoconductive surfaces of the respective cylinders.

Upon passing through the various printing stations, the web is fed through a standard punch ring to an image scanner. At this station, the printed image may be reproduced, again with the aid of laser beams, and converted to digital form and stored in the computer. Conventional feedback techniques are then employed to correct and/or improve specific areas of the form, or to make minor changes in the form format.

The web thereafter passes through laser operated punch heads and cross-perforation devices and is subsequently wound on a rewind roll.

It is to be understood that computer technology is employed to program the press to produce the desired printing, color application and so on at each of the printing stations. In a preferred embodiment, controls to the press as well as printing information are included in diskette or cassette form.

The press as described hereinabove has several attendant advantages. The overall weight of the press is substantially reduced, alleviating problems of readjustment and realignment due to distortion of heavy frame members and compression of floor contours.

The press as described hereinabove enjoys reduced power consumption since large motors (e.g., 7.5 hp) are utilized only to draw the paper through the press, with smaller additional motors (adding perhaps another 4 or 5 hp) used in the individual subsystems. This is to be compared with conventional prior art printing presses which normally use in excess of 50–60 hp.

The press as described hereinabove eliminates the use of conventional negatives and plates, along with the necessary chemicals. The computerization of all controls also eliminates the need for numbering machines and problems associated therewith. Our related copending U.S. application Ser. No. 281,062 filed Dec. 7, 1988, incorporated herein by reference, describes a controlled method and apparatus for automatic numbering of forms on a rotating printing press.

The immediate drying of the ink at the respective printing stations eliminates the necessity of conventional infrared and ultraviolet dryers.

Conventional makeready procedures are also radically altered. With the press according to this invention, the operator need only install a fresh roll of paper in the press, remove the finished roll, and select the appropriate program for manufacturing a business form of the desired size and format.

It may be further appreciated that even the loading and unloading of the paper rolls themselves may be automated to even further reduce the already minimized manual labor associated with press operation.

In the art of photocopying, it is recognized that so-called endless belts may be provided in which at least one cylinder is used to drive the belt. The belt is less expensive to manufacture than a cylinder and may be inexpensively and easily replaced when broken or when a coating affixed to the belt deteriorates to the point when it is no longer useful. For example, the following U.S. patents assigned to Ricoh Company, Ltd. of Japan are exemplary of endless belt apparatus: U.S. Pat. Nos. 4,668,072, 4,674,858, 4,751,549, 4,758,486 and 4,772,253. In particular, U.S. Pat. No. 4,772,258 incorporated herein by reference discloses a typical wide seamless, endless belt of sheet metal lined with flexible material on one side and having another side used as a substrate for electrostatic copying.

In summary, then, while a cylinder may provide a printing surface of indeterminate length, a cylinder is expensive to replace. Consequently, there remains a requirement in the art to provide an endless belt type of printing press, the endless belt of which, for example, may be adapted for printing applications from the copying arts.

SUMMARY OF THE INVENTION

It is therefore a primary object of the present invention to provide a printing press having an endless belt;

It is a further object of the present invention to provide multiple printing stations associated with the same endless belt;

It is a still further object of the present invention to provide for printing of two sides of a web of material, for example, for the printing of business forms.

These and other objects of the present invention are accomplished according to the principles of the present invention in which a printing station involving a rotating cylinder of a printing press according to U.S. Pat. No. 4,827,315 is replaced by an endless belt having at least one associated printing station. Multiple printing stations may be associated with the same endless belt, for example, for printing multiple colors or printing two sides of a business form in one color. For two sided printing, turning bars may be provided to reverse sides for printing the second side of a web of material. Also, for ease of maintenance and replacement, the printing belt may be at an angle from the vertical and be pivoted at its base to allow viewing of the printing area and access to the surface and the belt for changing.

In particular, a method of printing a web of continuous printing material on a printing press according to the present invention comprises the steps of:

(a) feeding the web of continuous printing material from a supply roll to at least one printing station;
(b) projecting at least a portion of an image to be printed on an endless moving belt;
(c) transferring the image on said endless moving belt to the web of continuous printing material at said printing station as the web and the image on the said endless moving belt move past each other;
(d) erasing the image from said endless belt immediately after said printing station;
(e) projecting the remaining portion of the image to be printed on said endless belt as it continues to move; and
(f) repeating steps (c), (d) and (e) to continuously print on the web of continuous printing material until a complete image is printed.

A printing press for continuously printing a web of continuous printing material according to the present invention comprises:

(a) feeder means for feeding the web of continuous printing material from a supply roll to at least one printing station;
(b) an endless movable belt;
(c) drive means for driving said endless movable belt past the printing station;
(d) projection means of the at least one printing station for projecting at least a portion of an image to be printed on said endless movable belt;
(e) transfer means for transferring the image on said endless movable belt to the web of continuous printing material at said printing station as the web and the image on said endless movable belt move past each other;
(f) erase means for erasing the image from said endless movable belt immediately after said image transfer, said projection means, transfer means and erase means thereafter projecting, transferring and erasing the remaining portion of the image to be printed as said endless movable belt and the web of continuous printing material continue to move past said printing station to thereby print a complete image on the web of continuous printing material.

Other objects and advantages of the invention will become apparent from the detailed description which follows.

DETAILED DESCRIPTION OF THE INVENTION

Figure 1:
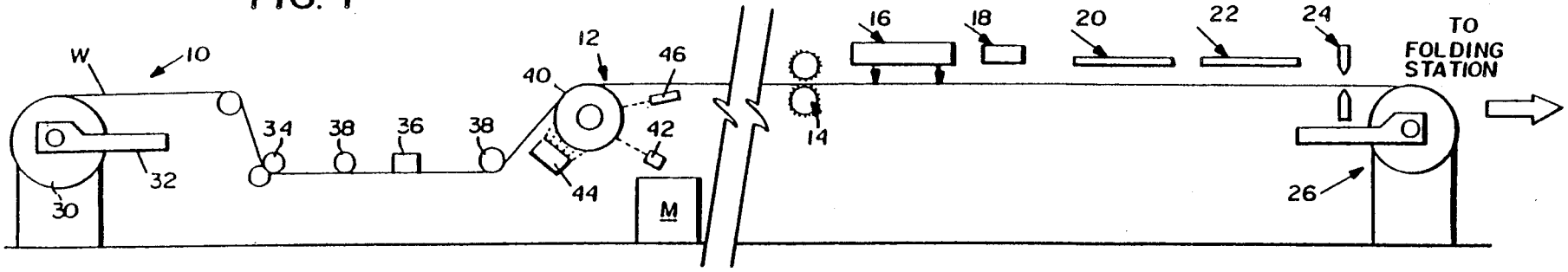
FIG. 1 is a schematic side view of a business forms printing press in accordance with an exemplary embodiment of the invention.
Figure 2:
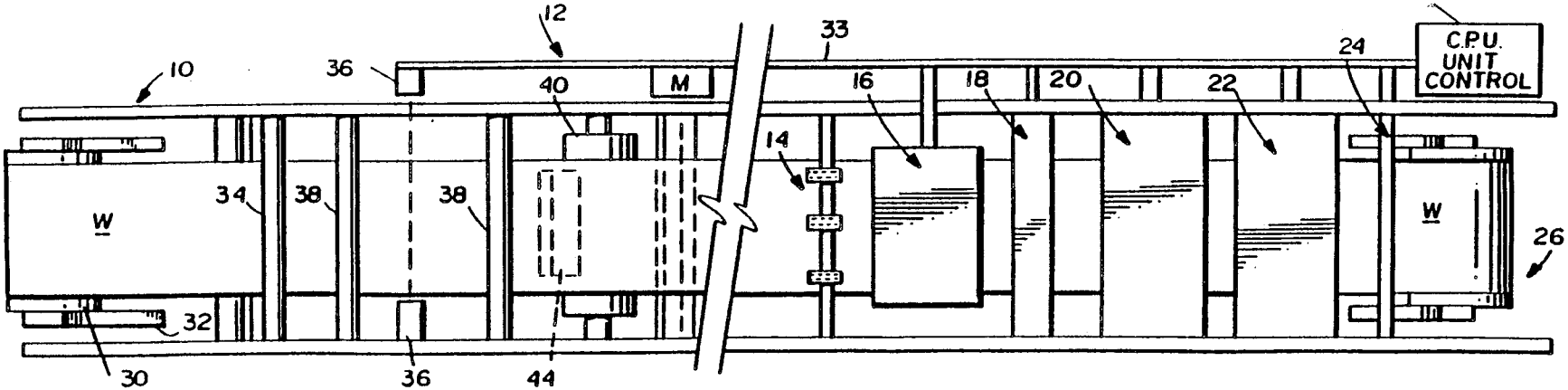
FIG. 2 is a schematic plan view of the press illustrated in FIG. 1.

Referring now to FIGS. 1 and 2, the business forms press of this invention generally includes an infeed supply station 10 for a web W, one or more printing stations 12, a line hole punch ring station 14, an image scanning station 16, a laser slitter station 18, a laser punch station 20, a laser cross perforation station 22, additional detectors 24 and a rewind station 26.

The infeed station 10 includes a conventional paper supply roll 30, provided with web guides 32 and feed rollers 34. In accordance with this invention, at least one laser detector 36 is provided for monitoring web thickness. While large variations in thickness are not normally found within a single paper roll, the second or third roll used in a process may, in fact, contain thickness variations large enough to create stretch problems in the web. The laser detector serves to alert the press operator of variations beyond a predetermined acceptable minimum so that the problem may be corrected. Detectors using laser radiation for measuring web thickness are not new per se. See, for example, U.S. Pat. No. 4,322,971, incorporated herein by reference, for a representative example of the type of detector which can be utilized in this invention.

A pair of compensator rolls 38 are employed in order to indicate slack and uneven feed of paper from the supply roll 30. These rolls are operatively connected with the central computer control unit 52 which adjusts the infeed rolls 34 as required.

The printing station 12 includes a unique, indeterminate length printing cylinder 40 which, as earlier stated, enables printing to any desired length or repeat. The cylinder 40 as will be described in connection with FIG. 6 may be replaced by endless belt apparatus which also provides a printing surface of indeterminate length. The endless belt apparatus may have more than one associated printing station.

In the present invention, each printing cylinder 40 (there may be as many as four cylinders or more arranged in series or alternatively a lesser number of endless belts) is preferably constructed of aluminum and coated with a suitable photoconductive surface for receiving an image from an image projector 42. The projector 42 utilizes lasers to project an image onto the photosensitive recording medium applied on the drum surface. In this regard, it is to be appreciated that the drum or cylinder at each printing station should be mounted for easy installation and removal so that the cylinder may be removed periodically for recoating.

In a manner understood by those in the art of laser technology, the printing stations will receive, for example, alpha and numeric character data in electronic form from the main computer control unit 52, as will be described further hereinbelow, and, in response to such data, print the desired characters on the moving web W. Each printing station 12 may have its own light motor drive M and its own computer (not shown). This computer could have its own program to control spacing and tension of the web in that particular station, but would, of course, interface with the main computer control 52.

After the image is projected onto the surface of the cylinder, a toner in the form of powder is applied at 44. The powder should be extremely fine grained so that when it is picked up by the surface, there is no waste or extraneous material thereon.

Figure 4:
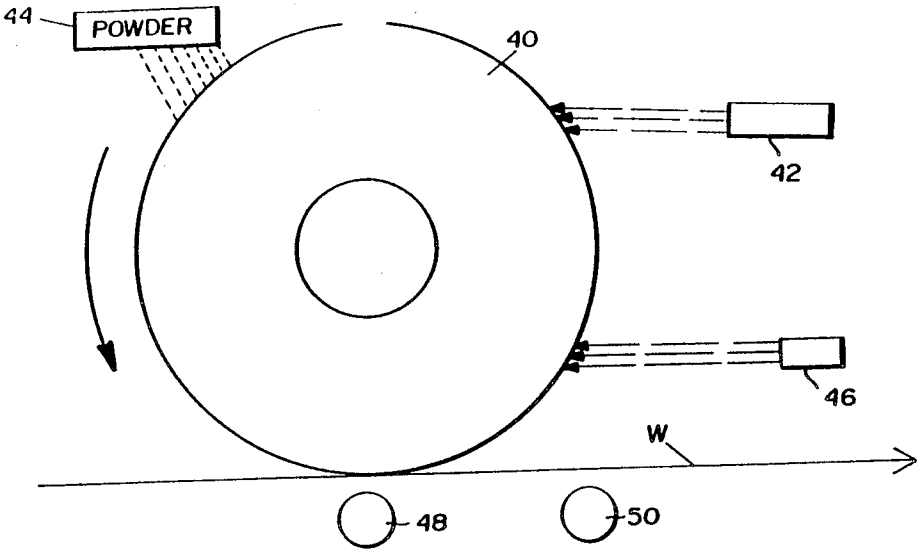
FIG. 4 is a schematic side view of a printing station in accordance with this invention.

After the characters have been applied to the web W as the drum surface rotates into engagement therewith, the powder is fused and chilled at 48, 50, respectively (see FIG. 4). Fusing temperatures should be greater than 300° F.

As the drum continues to revolve, the image is erased by an ionized image eraser 46. Here again, lasers are utilized to discharge the photoconductive surface of the printing drums or cylinders. Normally, the individual drums would be scanned to a required length, e.g., 24" on a 28" drum, and as the cylinder revolves past the printing point and the image is erased, a new or continuing image is projected on the cylinder. In this way, no open non-printing gaps are created.

It is to be understood that the size of the cylinder is not restricted to 28", but may be 22" or 26" or whatever size is most practical for the job at hand. In this regard, because of the effective infinite length of the cylinder, it is possible to print four (or more) 11" images and create a four-part form on a single sheet length of the continuous web. Conventional printing presses, and even those with newer laser printers are unable to create such four-part forms.

Projector 42, toner applicator 44 and image eraser 46 together with a point of contact with a cylinder 40 (or belt), for example, may define a printing station. A cylinder 40 may have multiple printing stations (not shown in FIG. 1).

The control and sequencing of the images to be projected on the drum will be discussed further hereinbelow.

As earlier stated, the laser drum printing station 12 described above is one of as many as four such stations, which may be arranged in series along the path of travel of the web W, each one applying a different one of four primary colors. Obviously, the type and style of form will dictate the number of colors, and hence the number of stations required.

It will be understood that the press may be programmed to have the printing stations print in any given sequence, by color, so that, for example, the first station would print black; the second, red; the third, blue; and the fourth, green.

After exiting the printing stations, the web W passes through a conventional line hole punch ring station 14 and below an image scanner 16, and thereafter through a laser slitter 18, laser punch head 20 and laser cross perforation cutter 22. The size, location, spacing, and so on of the various holes and slits is governed by the use of pre-programmed information on diskettes or cassettes, insertable in the main control unit as described further herein.

The image scanner 16 reproduces the printed image and resolves the four color image in a lathe type mechanism, picks out the colors and separates them by digitalizing, and produces four separate negatives, one for each color. Rather than producing a negative, this information could be conveyed directly to the printing stations of the press, particularly to correct and/or improve the work product, or transmitted by computer link to a remote press or presses.

After passing between detectors 24, which insure proper alignment and tautness of the paper web W, the paper is rewound at a stand 26.

As is apparent from FIG. 2, the various components of the press are connected via cable 33 to the main central computer processing unit 52 which is described hereinbelow in more detail in association with FIG. 3.

Figure 3:
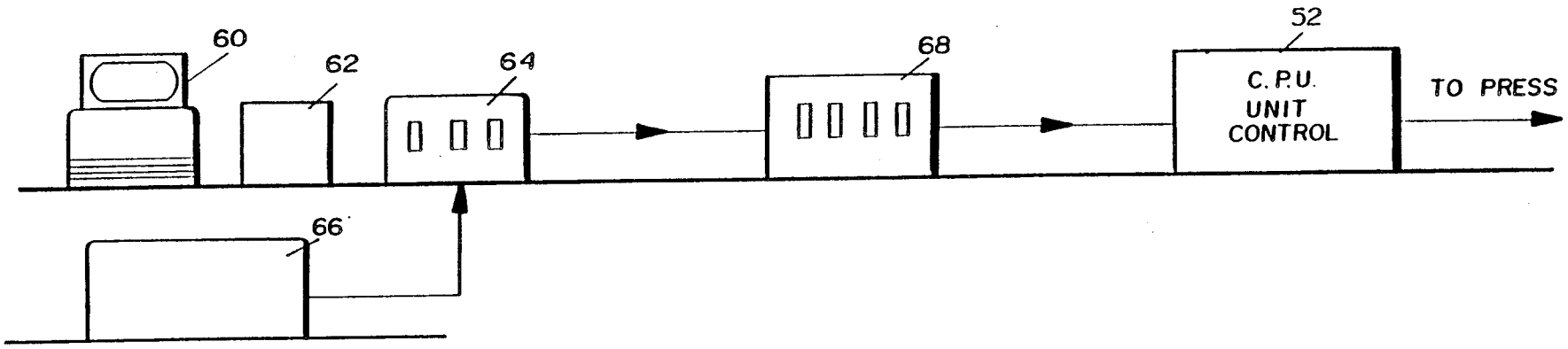
FIG. 3 is a schematic diagram of a central control unit for the printing press illustrated in FIG. 1 and 2.

In FIG. 3 there is illustrated a schematic diagram of the various components utilized to control the press of this invention. A forms composer with full color graphics, shown at 60, and a matrix color printer 62 for forms proofs are utilized in conjunction with a processor 64 and color scanner 66 to provide the central processor 52 with the necessary information regarding the four color composition of the forms. A console 68 is provided for inserting the various cassettes or diskettes for controlling each of the stations of the press, through the main computer control 52.

When the job is finished, the diskette is stored for a repeat order, and is ready to set the press for an exact repeat, or the diskette can be altered with new or deleted copy, without the necessity for resetting the total job, or reworking the press memory diskette section when needed.

Turning to FIG. 4, there is shown a close-up schematic of a laser printing station similar to that illustrated in FIG. 1 but wherein the web W passes below a drum 40. As the drum rotates in a counterclockwise direction, the image is projected onto the photosensitive surface of the drum at 42 and powder is applied at 44. After the image is transferred to the web W at the printing station, the powder is fused at 48 and chilled at 50. Immediately after image transfer, the image on the drum is erased at eraser 46.

In its broader aspects, the invention relates to the production of business forms by a process which includes the steps of (a) feeding a web from a supply roll to a printing station including at least one rotary printing cylinder; (b) projecting an image on the cylinder as said cylinder rotates; (c) applying toner to the cylinder; (d) transferring the image to the web as the cylinder rotates into engagement with the web; (e) erasing the image from the drum immediately after the drum disengages from the web; and (f) projecting a new image on the cylinder as the cylinder continues to rotate.

Figure 5:
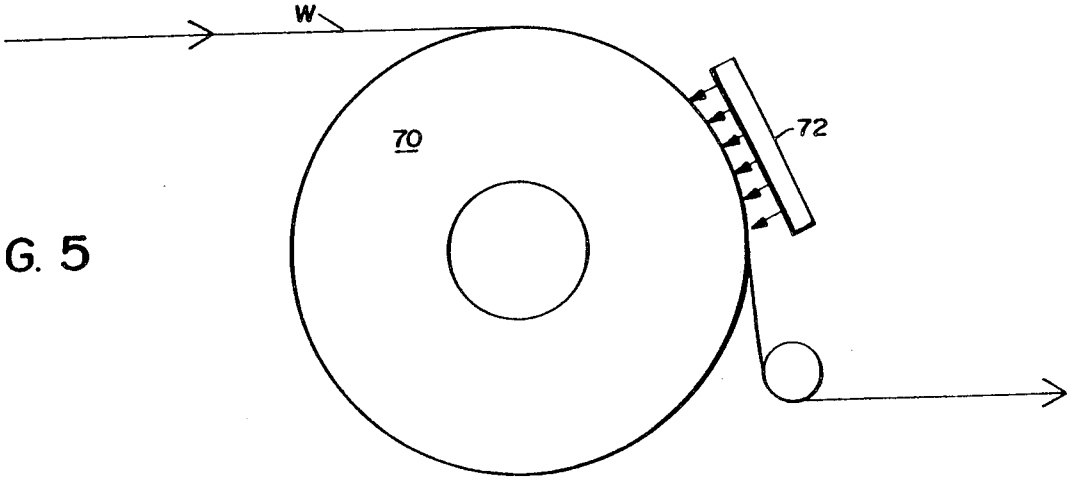
FIG. 5 is a schematic side view of an alternative embodiment of a printing station in accordance with this invention.

While the presently preferred process is carried out with printing stations utilizing laser printing technology, it will be understood by those skilled in the art that an ink jet type printer may also be employed. In FIG. 5, a web W is illustrated passing over and in contact with a drum 70 with an adjacent ink jet module 72 arranged to eject droplets of writing fluid or ink onto the web W in accordance with a selected computer program chosen to produce a particular business form.

Figure 6A:
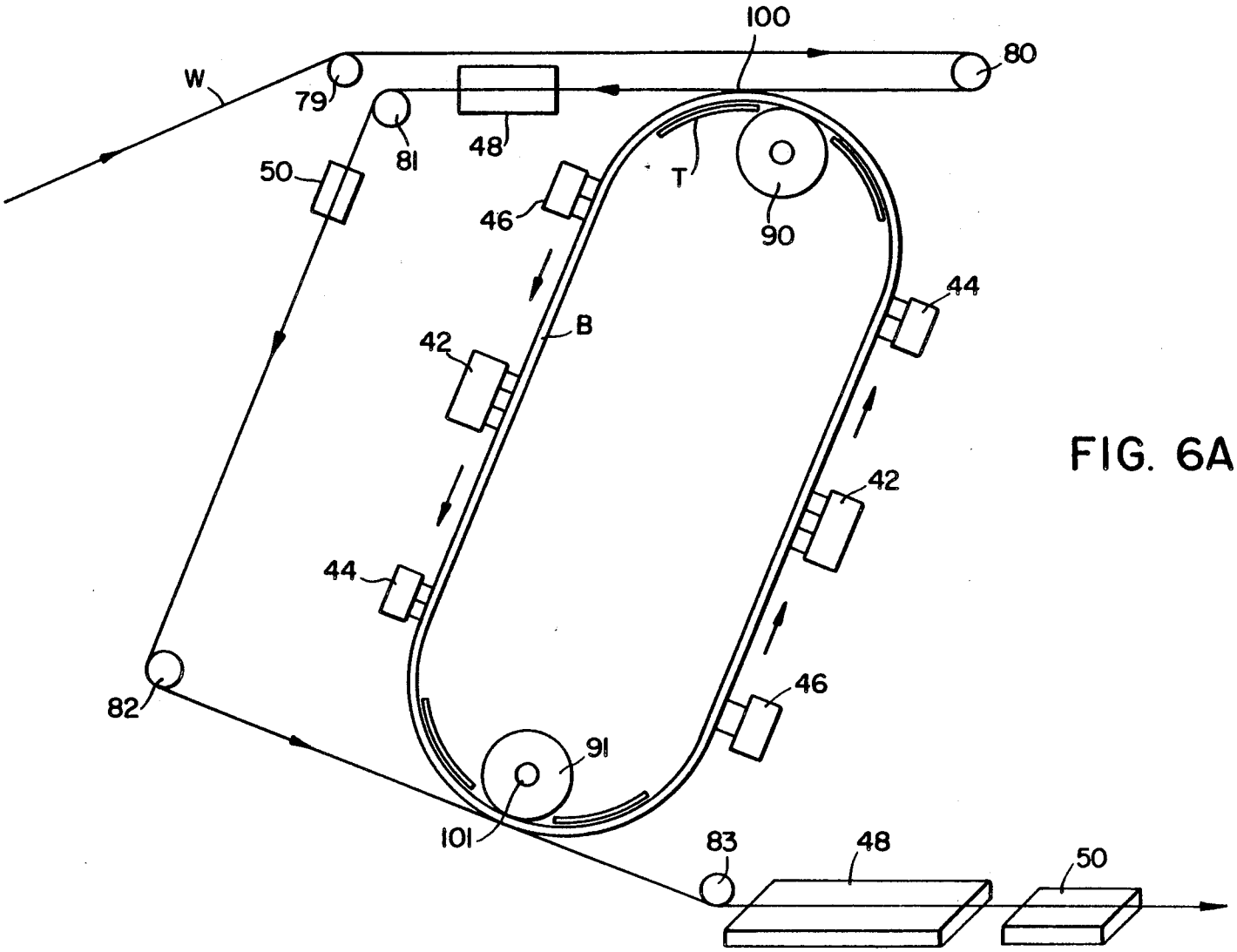
FIG. 6A is a schematic side view of an endless belt printing apparatus replacing printing station 12 of FIG. 1 in which a somewhat inflexible metallic belt is used.

Referring now to FIG. 6A, there is shown endless belt printing apparatus which may replace cylinder 40 of printing station 12 of FIG. 1. Web W in this embodiment travels by idler rollers 80 and 82 and rollers 79, 81 and 83 through the endless belt printing apparatus. First and second contact print points 100 and 101 are provided between web W and the endless belt B. Image projectors 42, toner applicators 44 and image eraser 46 are shown for each contact print point 100 and 101 defining two printing stations. One of ordinary skill may envision alternative embodiments of an endless belt, for example, in a triangle or diamond configuration providing three, four or more printing stations, respectively.

Once a first image is printed at a first station, the image is fused at fusing unit 48 and cooled at cooling unit 50 similarly as in FIG. 4. Similarly, after a second printing station, a second image is fused and cooled at units 48 and 50 respectively.

The belt B is driven by one roller, for example, roller 90 and a second roller 91 is driven by the belt. Roller 90, in turn, is driven by a drive shaft of the printing press. In the embodiment of FIG. 6A, the belt is assumed to be of aluminum and not particularly flexible. The aluminum belt travels around a rigid guide or track T especially in the vicinity of the first and second points of contact 100 and 101. Either drive roller 90 or driven roller 91, but preferably drive roller 90, is under spring load to maintain the belt B under tension and taught.

In one embodiment the drive and driven rollers are three inches in diameter and the belt is approximately twenty-eight inches in length. This twenty-eight inch length corresponds to the circumference of cylinder 40 described earlier. Also as described before, the twenty-eight inch length may be selected to be 24", 26" or any appropriate length for the job at hand. With a metal belt which is not particularly flexible as per U.S. Pat. No. 4,772,258, the turning radius of the belt B at the drive and driven ends may be considerably wider than if a belt of flexible Neoprene or Teflon materials is used. Neoprene and Teflon are trademarks of E. I. Dupont of Delaware. Just as with a cylinder 40, image transfer of an image of any repeat pattern is not dependent upon the length or circumference of belt B.

Figure 6B:
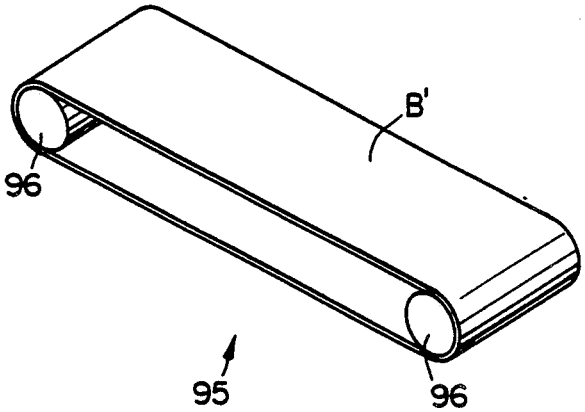
FIG. 6B shows a side view of a flexible belt having a photoconductive coating.
Figure 6C:
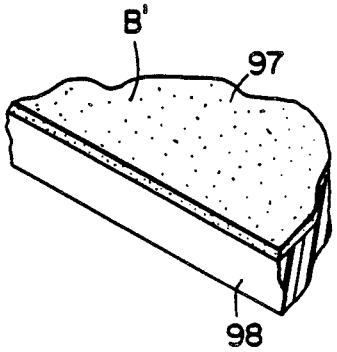
FIG. 6C shows an enlarged perspective view of the flexible belt of FIG. 6B in partial cross-section.

A flexible belt assembly 95 is shown in FIG. 6B which is thinner and has a width defined by the diameter of rollers 96. As best seen in FIG. 6C, a photoconductive coating 97 coats the flexible Neoprene or Teflon belt 98 on the side facing the imaging apparatus.

A first color may be printed at the first contact point 100 and a second at a second contact point 101. Consequently, all four colors may be printed by means of two endless belts or via four stations associated with a diamond-shaped belt assembly as described above.

Once printed, each of the two (or more) colors may be heat set at a heat set station 48 and chilled at cooling units 50 as per FIG. 4. As before, the color images may be set at temperatures in excess of 300° F.

According to FIG. 6A, the endless belt printing apparatus is assembled at an angle to the vertical. The assembly may pivot at the bottom and so swing open for ease of maintenance. For example, the assembly may be releasable from drive roller 90 which may be spring-loaded and pivot down about driven roller 91. In this example, units 46, 42 and 44 may be removable or swing free to permit the free pivoting of the assembly. By mounting the belt assembly at an angle, the printing surface may be more easily viewed and so checked for proper operation of the press.

Figure 7:
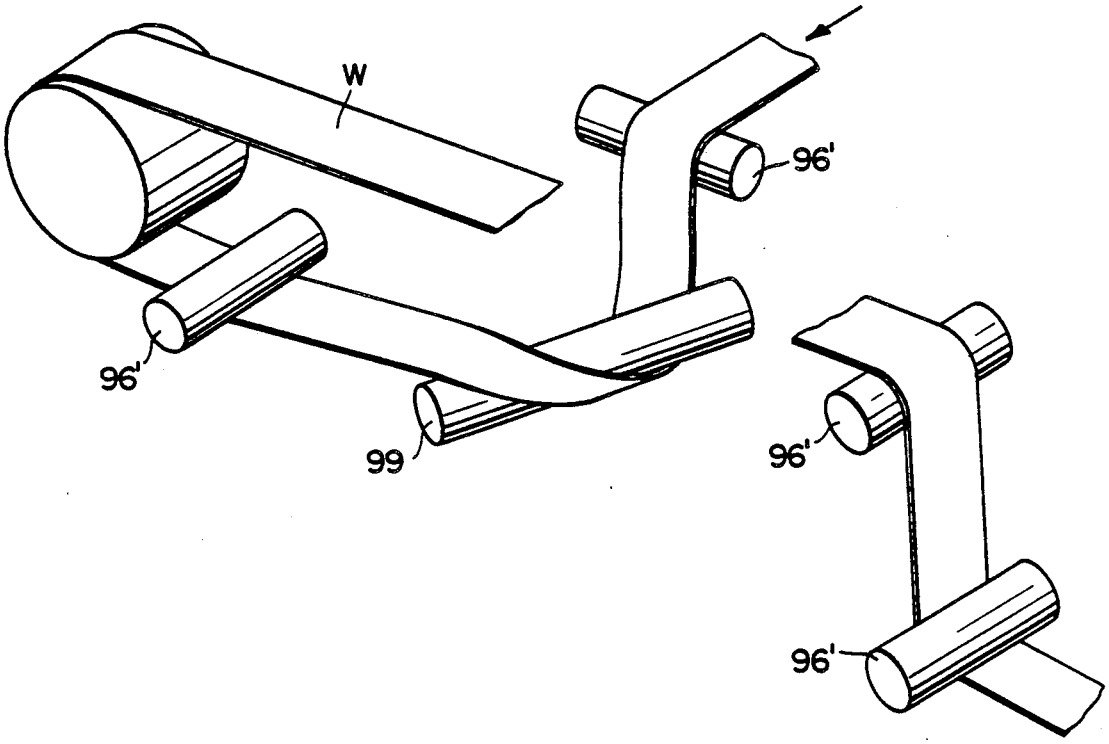
FIG. 7 is a schematic side view of turning apparatus by which a continuous web of material may be turned to print both sides.

Now referring to FIG. 7, turning apparatus of rollers 96 and turn bars 99, for example, of cadmium or chromium is shown for turning a web W of material so that a first image may be printed on one side and a second image on the reverse as, for example, for the printing of two sided business forms. Alternate web turning apparatus known in the art may be used to turn web W to the apparatus of FIG. 7. Conventional turnbar apparatus includes, for example, turnbar apparatus associated with either the Schriber Model 500 or Hamilton presses.

The present invention has been described particularly in the context of printing business forms per se. It is comtemplated that the computerized process of this invention may further be utilized to produce bar coding or serial numbers on the forms in a simple and efficient manner. Our copending application Ser. No. 281,062 filed Dec. 7, 1988 entitled "Method and Apparatus for Automatic Numbering of Forms on a Rotary Printing Press" provides particular detail on accomplishing a bar coding, serializing or other sequential printing of forms and is incorporated herein by reference. It will be further appreciated that the indeterminate length cylinder or endless belt as disclosed herein may also be advantageously employed in the production of other web-oriented processes, for example, in the publishing field, and in the printing of wallpaper. In the production of the latter, a customized product could be produced with a continuously varying pattern, i.e., at no point in a room need there be a pattern repeat.

It will be apparent that many additional changes and alterations may be made in the present invention without departing from the spirit and scope of the claims which follow.

We claim:

1. A method of printing a web of continuous printing material on a printing press comprising the steps of:
   (a) feeding the web of continuous printing material from a supply roll to at least one printing station;
   (b) projecting at least a portion of an image to be printed on an endless moving belt;
   (c) transferring the image on said endless moving belt to the web of continuous printing material at said printing station as the web and the image on said endless moving belt move past each other;
   (d) erasing the image from said endless belt immediately after said printing station;
   (e) projecting the remaining portion of the image to be printed on said endless belt as it continues to move; and
   (f) repeating steps (c), (d) and (e) to continuously print on the web of continuous printing material until a complete image is printed.

2. A method as defined in claim 1 further comprising the steps of scanning the image transferred to the web for variations from a predetermined image design and compensating for such variations.

3. A method as defined in claim 1 wherein steps (a) through (f) are carried out at a plurality of printing stations, each printing station for printing in a different color.

4. A method as defined in claim 1 wherein step (b) is carried out utilizing a plurality of lasers.

5. A method as defined in claim 1 wherein said endless belt is a rotating belt having a photoconductive surface.

6. A method as defined in claim 5 wherein said projecting step projects a charged image on the photoconductive surface of said rotating belt, and wherein the method further comprises the step of applying toner to the charged image on the photoconductive surface of said rotating belt, and said transferring step transfers toner to the web of continuous printing material in accordance with the charged image.

7. A method as defined in claim 6 further comprising the step of fixing the toner image on the web of continuous printing material.

8. A method as defined in claim 1 wherein said projecting step projects a constantly changing image.

9. A method as defined in claim 1 wherein said projecting step projects a succession of different images.

10. A method as defined in claim 9 wherein said transferring step successively transfers the succession of different images on said endless belt to the web of continuous printing material and said erasing step erases the succession of different images from said endless belt immediately after said printing station.

11. A method as defined in claim 1 further comprising the step of monitoring the thickness of the web prior to step (b).

12. A method as defined in claim 1 further comprising the steps of slitting or perforating the web in predetermined locations, and rewinding the web.

13. A method as defined in claim 1 wherein steps (a) through (f) are controlled by a pre-selected computer program.

14. A method as defined in claim 1 further comprising the step of repeating steps (a) through (f) to continuously print a series of complete images.

15. A method as defined in claim 1 wherein steps (a) through (f) are carried out at a plurality of printing stations of the endless moving belt.

16. A method of printing a web of continuous printing material on a printing press comprising the steps of:

(a) moving a web of continuous printing material from a supply roll to a printing station;

(b) projecting constantly changing images onto the peripheral surface of an endless belt having a predetermined circumference;

(c) transferring the constantly changing images onto the moving web of continuous printing material as it engages the peripheral surface of said endless belt, wherein the length of the image applied to the web is independent of the circumference of said endless belt; and (d) erasing the images from said endless belt immediately after step (c).

17. A method as defined in claim 16 further comprising the step of repeating steps (a) through (d) until a complete image to be printed is transferred to the web of continuous printing material.

18. A method as defined in claim 17 wherein the image to be printed is a business form and the constantly changing image is formed by at least alpha and numeric character data, the amount of alpha and numeric character data transferred to the web by said transferring step being independent of the circumference of said endless belt.

19. A method as defined in claim 16 wherein steps (a) through (d) are carried out in accordance with a pre-selected computer program.

20. A method as defined in claim 16 wherein steps (a) through (d) are carried out at a plurality of printing stations, each station for printing in a different color.

21. A printing press for continuously printing a web of continuous printing material comprising:

(a) feeder means for feeding the web of continuous printing material from a supply roll to at least one printing station;

(b) an endless movable printing device;

(c) drive means for driving said endless movable printing device past the printing station;

(d) projection means of the at least one printing station for projecting at least a portion of an image to be printed on said endless movable printing device;

(e) transfer means for trnasferring the image on said endless movable printing device to the web of continuous printing material at said printing station as the web and the image on said endless movable printing device move past each other;

(f) erase means for erasing the image from said endless movable printing device immediately after said image transfer, said projection means, transfer means and erase means thereafter projecting, transferring and erasing the remaining portion of the image to be printed as said endless movable printing device and the web of continuous printing material continue to move past said printing station to thereby print a complete image on the web of continuous printing material.

22. A printing press as defined in claim 21 wherein said projection means, transfer means and erase means respectively project, transfer and erase a succession of images to be printed.

23. A printing press as defined in claim 22 wherein the succession of images to be printed are business forms formed by at least alpha and numeric character data, the amount of alpha and numeric character data in each image being transferred to the web by said transfer means being independent of the length of said endless movable printing device.

24. A printing press according to claim 21 wherein said projection means projects a constantly changing image.

25. A printing press according to claim 21 wherein said projection means, transfer means and erase means operate in response to a pre-selected computer program.

26. A printing press according to claim 21 wherein said endless movable printing device is a rotating belt having a photoconductive surface, said projection means charges the photoconductive surface with a charged image corresponding to the image to be printed, and said transfer means includes toner means for applying toner to the charged image on the photoconductive surface and transferring the toner to the web of continuous printing material to print the image as said rotating belt and the web move past each other, said printing press further comprising fixing means for fixing the toner on the web of continuous printing material and said erase means comprising discharge means for discharging the photoconductive surface of said rotating belt.

27. A printing press as defined in claim 21 wherein said projection means includes a plurality of lasers at each of a plurality of printing stations.

28. A printing press as defined in claim 21 further comprising forming means for slitting or perforating the web of continuous printing material.

29. A printing press as defined in claim 21 further comprising scanning means for scanning the image transferred to the web for variations from a predetermined image design and compensating means coupled to said scanning means for compensating for the variations.

30. A printing press as defined in claim 21 further comprising a plurality of printing stations, each printing station for printing in a different color or for printing two sides of the web.

31. A printing press as defined in claim 21 wherein an assembly comprising the endless movable printing device and the drive means is mounted at an angle from the vertical.

32. A printing press as defined in claim 21 wherein an assembly comprising the endless movable printing device and the drive means is pivotably mounted in the printing press.

* * * * *